US006386135B1

(12) United States Patent
Oshima

(10) Patent No.: US 6,386,135 B1
(45) Date of Patent: May 14, 2002

(54) FREESTANDING CYLINDRICAL INDICATOR

(75) Inventor: Reiji Oshima, Ichikawa (JP)

(73) Assignee: Wanbishi Industry Co., Ltd., Tokyo (JP)

( * ) Notice: Subject to any disclaimer, the term of this patent is extended or adjusted under 35 U.S.C. 154(b) by 0 days.

(21) Appl. No.: 09/494,886

(22) Filed: Jan. 31, 2000

(30) Foreign Application Priority Data

Feb. 8, 1999 (JP) ..... 11-030689

(51) Int. Cl.[7] ..... E01F 9/00

(52) U.S. Cl. ..... 116/63 C; 116/63 P; 404/10; 248/158

(58) Field of Search ..... 116/63 C, 63 P, 116/63 R; 404/9, 10; 248/127, 158

(56) References Cited

U.S. PATENT DOCUMENTS

| | | | | | |
|---|---|---|---|---|---|
| 3,192,889 | A | * | 7/1965 | Crudgington | 116/63 R |
| 3,521,596 | A | * | 7/1970 | Schlein | 116/63 R |
| 4,462,145 | A | * | 7/1984 | Schulze | 116/63 T |
| 4,466,376 | A | * | 8/1984 | Wells | 116/63 P |
| 4,594,808 | A | * | 6/1986 | Rhee | 43/134 |
| 4,803,805 | A | * | 2/1989 | Goldberg | 47/41.12 |
| 5,090,349 | A | * | 2/1992 | Wilson | 116/63 C |
| 5,168,827 | A | * | 12/1992 | Junker | 116/63 P |
| 5,488,792 | A | * | 2/1996 | Kwok | 116/63 C |
| 5,630,675 | A | * | 5/1997 | Boeger | 116/63 C |
| 5,713,694 | A | * | 2/1998 | Monda et al. | 116/63 P |
| 5,755,528 | A | * | 5/1998 | Kulp et al. | 404/6 |
| 5,823,850 | A | * | 10/1998 | Watkins | 446/475 |

FOREIGN PATENT DOCUMENTS

| | | | | |
|---|---|---|---|---|
| GB | 2096214 A | * | 10/1982 | 116/63 C |
| GB | 2100322 A | * | 12/1982 | 404/9 |
| JP | 06329187 A | * | 11/1994 | |
| JP | 3041934 | | 7/1997 | |

* cited by examiner

*Primary Examiner*—Diego Gutierrez
*Assistant Examiner*—Lydia De Jesus
(74) *Attorney, Agent, or Firm*—Blackwell Sanders Peper Martin LLP

(57) ABSTRACT

A freestanding cylindrical indicator of the present invention comprises a cylindrical indicating body and a supporter for holding the indicating body in an upright position. The indicating body has a fitting portion and the supporter has an inserting portion for joining with the fitting portion. Joining the inserting portion of the supporter with the fitting portion of the indicating body enables to fit the indicating body into the supporter. The freestanding cylindrical indicator is set up for, for example, being placed on a road to separate the passage of vehicles or pedestrians or being used as a medium to indicate various types of announcements, advertisements and messages.

8 Claims, 5 Drawing Sheets

FREESTANDING CYLINDRICAL INDICATOR

BACKGROUND OF THE INVENTION

1. Field of the Invention

The present invention relates to a freestanding cylindrical indicator, which is used, for example, by being placed on a road to separate the passage of vehicles or pedestrians or as a medium for indicating various types of announcements, advertisements and messages.

2. Description of the Related Art

A conventional indicating cylinder used on site of roadwork is, for example, generally corn-shaped made of plastics or the like. Such an indicating cylinder has a certain weight because it is made of a synthetic resin or the like to have a certain thickness. Therefore, the transportation becomes difficult. It also has a disadvantage that it is hard to provide a storage space therefor because it has a certain size.

An indicating cylinder having the aforementioned disadvantage solved is known disclosed in Japanese Registered Utility Model No. 3041934.

The indicating cylinder of the aforementioned prior art has a three-dimensional shape such as a pyramid which is formed by folding a spread cardboard, fixing joined ends by means of rivets and detachably fixing a base thereto by an adhesive agent or the like so as to have a freestanding structure.

The structure as described above, enables the indicating cylinder to be made light in weight and be folded after the assembling. Therefore, it saves labor in transportation and a space for the storage.

In such a foldable indicating cylinder, the indicating cylinder and the base is made of a same cardboard so that the weight can be reduced.

When the indicating cylinder is set up for use outdoors, however, it is necessary to put a weight on the base to prevent it from being tumbled due to strong wind because it is exposed to rain or wind.

There is also a problem that the foldable indicating cylinder becomes unusable because an adhesive agent or the like is used at the fitting portion between the indicating cylinder and the base when the adhesive strength is degraded due to an influence of natural circumstances or adhesion of dust and the like in a long term.

SUMMARY OF THE INVENTION

It is an object of the present invention to provide a freestanding cylindrical indicator which can have an indicating body and a supporter securely joined by a simple operation.

Another object of the invention is to provide a freestanding cylindrical indicator which can stably hold the indicating body in an upright position.

The freestanding cylindrical indicator of the present invention comprises a cylindrical indicating body and a supporter for holding the indicating body in an upright position. The indicating body comprises a fitting portion. The supporter comprises an inserting portion, which is joined with the fitting portion.

In the freestanding cylindrical indicator of the present invention, the indicating body in an upright position may be stably mounted on the supporter by joining the fitting portion of the indicating body to that of the supporter.

In the freestanding cylindrical indicator of the present invention, the cylindrical indicating body, for example, may be detachably mounted on the supporter. The indicating body in an upright position can be stably mounted on the supporter by joining the fitting portion of the indicating body with the inserting portion of the supporter.

Furthermore, as an example of the cylindrical indicating body, the freestanding cylindrical indicator of the present invention has a cylindrical body with a cross section elliptic, the top end being smaller than the bottom end and the top end closed.

Bonding a single or two sheets of sheet members forms the cylindrical body. A fitting portion comprised of a hole is formed on the side of the bottom end.

Meanwhile, the supporter for holding the indicating body in an upright position has an elliptic supporting ring in the same shape as the indicating body. The supporting ring is provided with an engaging portion, which is inwardly protruded and opposed to an inserting potion to be fitted into the fitting portion of the cylindrical body.

Moreover, the elliptic supporting ring is pulled over to let through the indicating body from the top side and pushes the cylindrical body in the direction of the minor axis utilizing a tapered surface of the cylindrical body. During the operation, the cylindrical body is forced to expand in the direction of the minor axis by the binding force of the supporting ring, so that the cylindrical body is dented to let the inserting portion into the hole but instantaneously expanded to the direction of the minor axis when the inserting portion of the supporting ring come to the same position as the hole of the cylindrical body.

Therefore, the inserting portion of the supporting ring does not come out of the hole of the cylindrical body.

Furthermore, in order to remove the cylindrical body from the supporting ring, the cylindrical body is pushed to shrink in the direction of the minor axis so as to release the inserting portions from the holes. In this state, moving the supporting ring toward the top end of the cylindrical body enables easy disassembling.

BRIEF DESCRIPTION OF. THE DRAWING

DESCRIPTION OF THE PREFERRED EMBODIMENTS

First Embodiment

Figure 1:
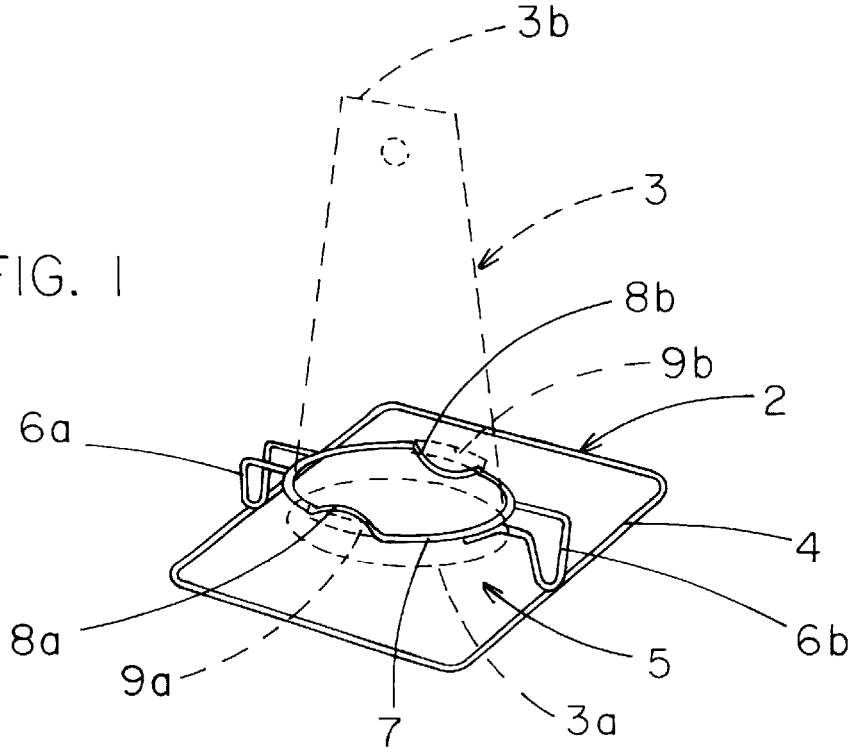
FIG. 1 is a diagonal diagram of a supporter of a freestanding cylindrical indicator according to a first embodiment of the present invention.
Figure 2:
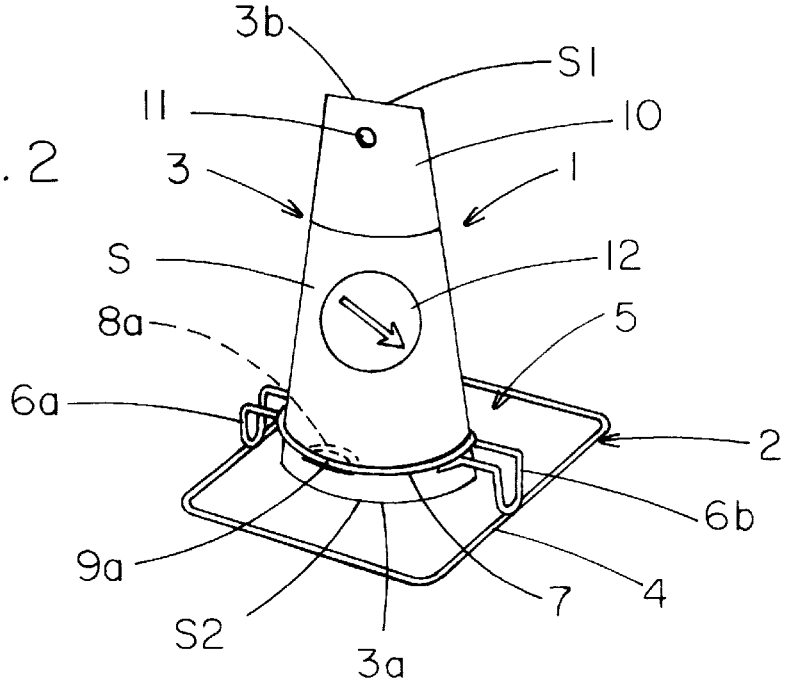
FIG. 2 is a diagonal diagram of the freestanding cylindrical indicator according to the first embodiment of the present invention.

Referring to FIG. 1 and FIG. 2, a freestanding cylindrical indicator 1 according to the first embodiment comprises a cylindrical body 3 which is made of, for example, a cardboard sheet S and a supporter 2 which has a relatively heavy structure detachably fitted to the cylindrical body 3 so as to hold it in an upright position.

The supporter 2 comprises, for example, a base 4 which is formed to have a wide rectangular or square shape by bending a steel wire and a supporting ring 7 which is fitted to the top face of the base 4.

The supporting ring 7 is formed to have an elliptic shape by bending the same steel wire as the base 4 and a pair of interlocking portions 8*a,* 8*b* are protruded by inwardly bending the two mutually opposing portions in the direction of a minor axis.

Furthermore, the supporting ring 7 has connectors 6*a,* 6*b* which are bent into an L-shape mounted on the both ends in the longitudinal direction. The supporting ring 7 is mounted on the square base 4 through the connectors 6*a,* 6*b* by means of welding for example.

On the other hand, the cylindrical body 3 is formed to be a cylindrical body with a bottom having an ellipse cross section by bonding a sheet of long trapezoidal cardboard sheet S whose top end S1 is shorter than a bottom end S2.

The cylindrical body 3 is, for example, made of a sheet of trapezoidal cardboard sheet S. The cardboard sheet S has a folding line marked in a position where the cardboard sheet S is folded into two equal sections in the longitudinal direction. Each section of the cardboard sheet S has the two edges inwardly folded to form flaps except the bottom end S2 thereof. The cylindrical body 3 is formed by folding the cardboard sheet S along the folding line so as to join the opposing faces together and bond the flaps by an adhesive agent.

The cardboard sheet S has slits 9*a,* 9*b* formed in the vicinity of the bottom end. The cardboard sheet S has, for example, a red-colored beltlike indicating portion 10 printed on the top end side and an indicating mark 12 on both sides about the middle section. A through hole 11 is formed in the beltlike indicating portion 10 in the vicinity of the top end.

Thus, the cylindrical body 3 is tapered from the bottom end 3*a* toward the top end 3*b* and the top end 3*b* is closed.

Figure 4:
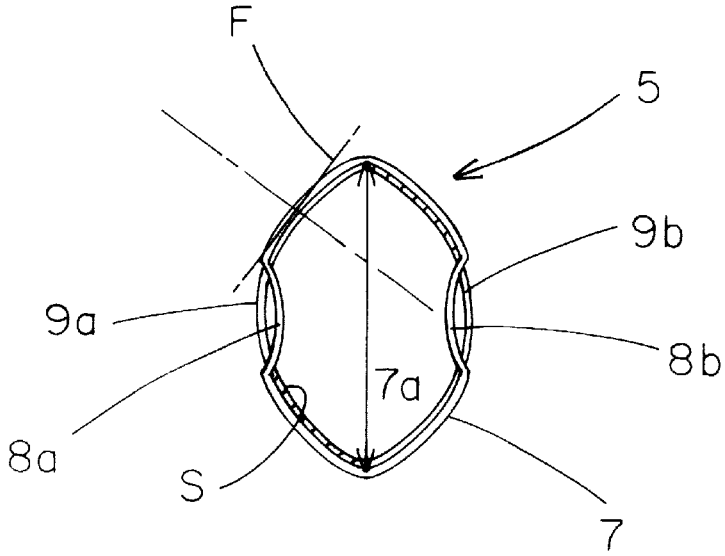
FIG. 4 is an explanatory diagram of the action of self-shape retentivity produced when a cylindrical body is mounted on a fitting portion to assemble the freestanding cylindrical indicator according to the first embodiment of the present invention.

On the other hand, the slits 9*a,* 9*b* formed in the vicinity of the bottom end serve to function as holes crossing the axis of the cylindrical body 3 as shown in FIG. 4.

A length of the bottom end 3*a* of the cylindrical body 3 is determined to be longer than a length 7*a* of the supporting ring 7 of the supporter 2 in the direction of the major axis.

When the cylindrical body 3 is inserted into the supporting ring 7 of the supporter 2 as will be described afterward, it is pushed and expanded in the direction of the minor axis by a binding force of the supporting ring 7. When the outer periphery of the cylindrical body 3 substantially coincides with the inner periphery of the supporting ring 7, the slits 9*a,* 9*b* formed in the vicinity of the bottom end face to the pair of interlocking portions 8*a,* 8*b* of the supporting ring 7.

Now, an assembling procedure of the freestanding cylindrical indicator 1 according to the first embodiment will be described with reference to FIG. 3 and FIG. 4.

Figure 3:
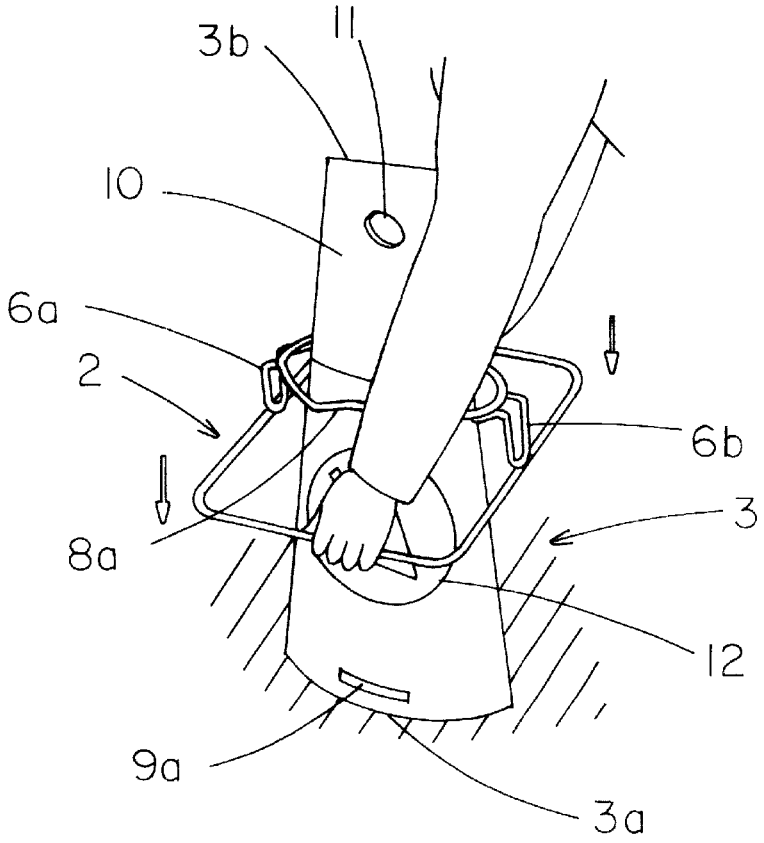
FIG. 3 is a diagram to explain the assembling procedure of the freestanding cylindrical indicator according to the first embodiment of the present invention.

First, the supporter 2 is lowered to pull over the supporting ring 7 of the supporter 2 to let through the cylindrical body 3 held in an upright position from the top end 3*b* as shown in FIG. 3. By lowering the supporter 2, the inner periphery of the supporting ring 7 comes in contact with the outer periphery of the cylindrical body 3. By further lowering the supporter 2 downward, the cylindrical body 3 is pushed and deformed with force to expand applied in the direction of the minor axis by the supporting ring 7.

Moreover, when the outside shape of the cylindrical body 3 substantially matches with the inside shape of the supporting ring 7, pushing and lowering the supporter 2 is prevented.

At this point, the pair of interlocking portions 8*a,* 8*b* of the supporting ring 7 are engaged with the slits 9*a,* 9*b* in the vicinity of the bottom end of the cylindrical body 3.

Then, self-shape retentivity of the cylindrical body 3 acts on the inner periphery of the supporting ring 7.

In other words, the cylindrical body 3 in an elliptic shape has all the outer peripheral surface as the external surface configured of an outward tangent lines (code F in FIG. 4) so that the self-shape retentivity (force to open externally) of the cylindrical body 3 acts on the inner periphery of the supporting ring 7, and the cylindrical body 3 is mounted on the supporter 2 by being elastically pushed against the inner periphery of the supporting ring 7 of the supporter 2 when the outer peripheral surface of the cylindrical body 3 comes in contact with the inner periphery of the supporting ring 7. When the cylindrical body 3 is mounted on the supporter 2, the self-shape retentivity of the cylindrical body 3 produced with the mounting portion is used to keep the engagement of the interlocking portions 8*a,* 8*b* and the slits 9*a,* 9*b,* so that the cylindrical body 3 is restricted to moving in the axial direction (vertical direction).

Therefore, even when an external force is inwardly applied to a part of the outer periphery of the cylindrical body 3, the cylindrical body 3 is stably held on the supporter 2 without easily disengaging the slits 9*a,* 9*b* from the interlocking portions 8*a,* 8*b.* Forming the supporting ring 7 in an ellipse shape as shown in the present embodiment improves the discrimination of the indication marks on the cylindrical body 3 from the front and back sides.

Besides, since the cylindrical body 3 is tapered from the bottom end 3*a* toward the top end 3*b,* in a state that the cylindrical body 3 is contacted to the inside of the supporting ring 7 by pulling over the supporter 2 to let through the cylindrical body 3 from the top end, 3*b,* a simple operation of suppressing it in the axial direction enables to engage the interlocking portions 8*a,* 8*b* of the inner periphery of the supporting ring 7 with the slits 9*a,* 9*b* and securely mount the cylindrical body 3 on the supporter 2.

Figure 5:
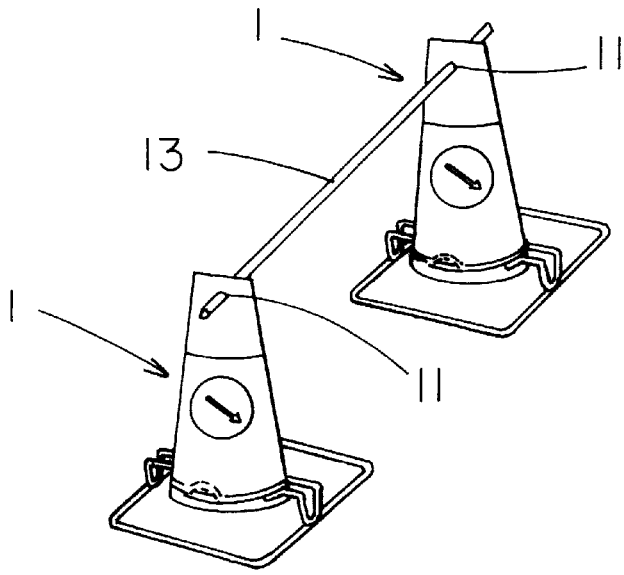
FIG. 5 is an explanatory diagram of an example of using a plurality of the freestanding cylindrical indicators connected according to the first embodiment of the present invention.

FIG. 5 shows an example of using the freestanding cylindrical indicator 1 according to the first embodiment.

As described above, the cylindrical body 1 has a through hole 11 formed at the top end 3*b.* Therefore, when two freestanding cylindrical indicators 1 are, for example, used in a mutually connected state, the through hole 11 is used for letting through and holding a bar 13 so that connecting the freestanding cylindrical indicators 1 enables to simply divide a large area.

In the example of usage described above, the two freestanding cylindrical indicators 1 are connected by one bar 13. However, a method of connecting them is arbitrary. For example, the bar 3 may be made long so that a plurality of freestanding cylindrical indicators 1 can be connected by means of the bar 13. The bar 13 may also have a desired length by means of any connecting tool. The connecting tool can be made of a flexible material so that it can be bent at any part of it. It is also possible to have any arrangement by using an L-shaped or U-shaped connecting tool.

Specifically, the connection of the freestanding cylindrical indicators 1 by means of the bar according to the first embodiment can be decided as required depending on application purposes and uses.

According to the first embodiment described above, the cylindrical body 3 is made of a single sheet of cardboard sheet S. However, the cylindrical body may be formed to be a cylindrical body with a bottom having an elliptic cross section by bonding two sheets of long trapezoidal cardboard sheet S whose top end S1 is shorter than a bottom end S2. In this case, for example, it is formed by inwardly folding three edges of each sheet except the bottom end S2 thereof to form flaps and bond the mutually opposing flaps by an adhesive agent.

The cylindrical body 3 made of the two sheets of cardboard sheet S makes it possible to form an indicator in a large size.

In other words, the cylindrical body 3 made of a single sheet of cardboard sheet S may be hard to form a large indicator because the size of the cylindrical body 3 is limited by a size of cardboard sheet S to be cut out.

Second Embodiment

Figure 6:
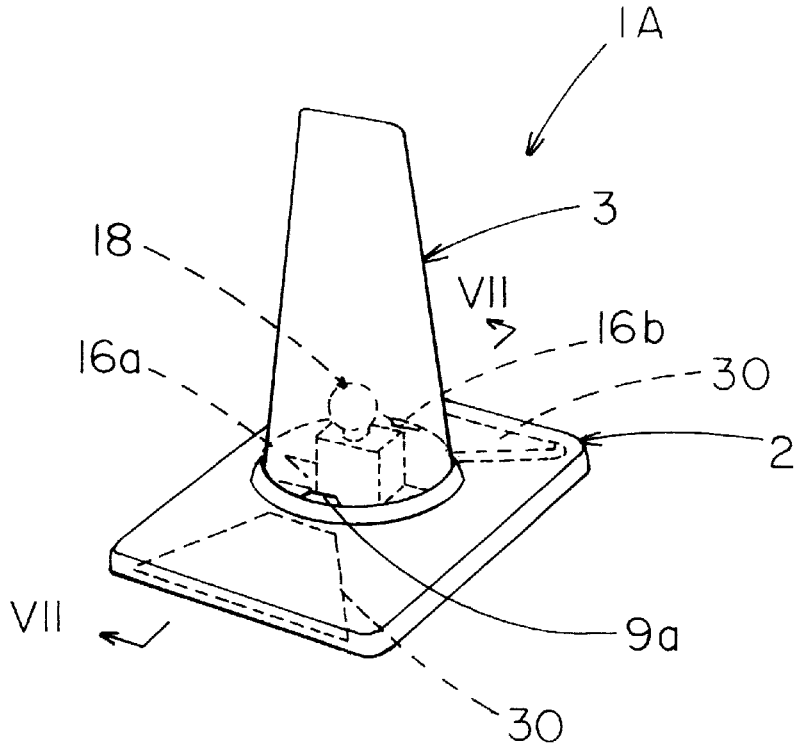
FIG. 6 is a diagonal diagram of a freestanding cylindrical indicator according to a second embodiment of the present invention.
Figure 7:
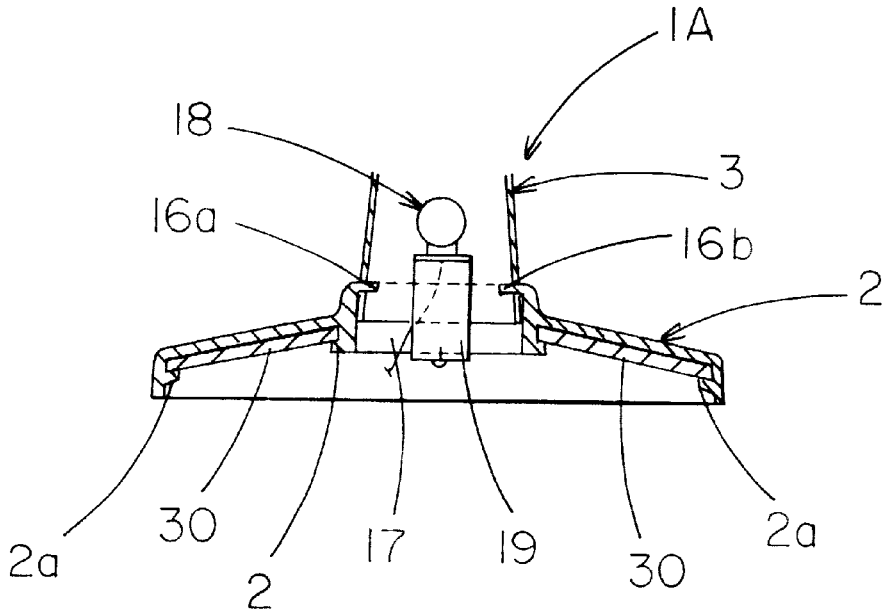
FIG. 7 is a cross sectional diagram taken along line A—A of FIG. 6.

FIG. 6 and FIG. 7 show a freestanding cylindrical indicator 1A according to the second embodiment of the present invention.

A supporter 2 of the present embodiment is made of a synthetic resin and has an opening 17 formed on the top for allowing the insertion of a cylindrical body 3. Inward interlocking portions 16*a,* 16*b* are integrally formed on the inner periphery of the opening 17. In the opening 17, an electric lamp 18 is mounted on the supporter 2 through a fitting member 19. The interlocking portions 16*a,* 16*b* used for mounting the cylindrical body 3 may be formed on the supporter 2 which is made of a synthetic resin or the like.

The cylindrical body 3 is made of a member having a light transmission property such as thin paper, e.g., Japanese paper, or a sheet member made of a sheet-like synthetic resin. Therefore, the electric lamp 18 as shown in the Figure is mounted in the cylindrical body 3 to illuminate the whole cylindrical body 3 so that the cylindrical body 3 can be used in the night.

Since the cylindrical body 3 is formed with the top end 3*b* closed, uniform light can be obtained owing to diffused reflection of light within the cylindrical body 3. Accordingly, a light source can be made small. Especially, the effect is remarkable when the sheet member is YUPO (trade name; it is made of polypropylene) manufactured by Oji-Yuka Synthetic Paper Co., Ltd.

The back side of the supporter 3 of the present embodiment as shown in FIG. 7, is provided with a rib 2*a* which is used to set a removable weight 30 in an appropriate weight. Thus, the weight 30 is removable so that the cylindrical body 3 is readily carried without the weight 30, and at the same time the stability of the freestanding cylindrical indicator can be easily enhanced with the weight 30 which applies an appropriate weight to the supporter 2.

Figure 8:
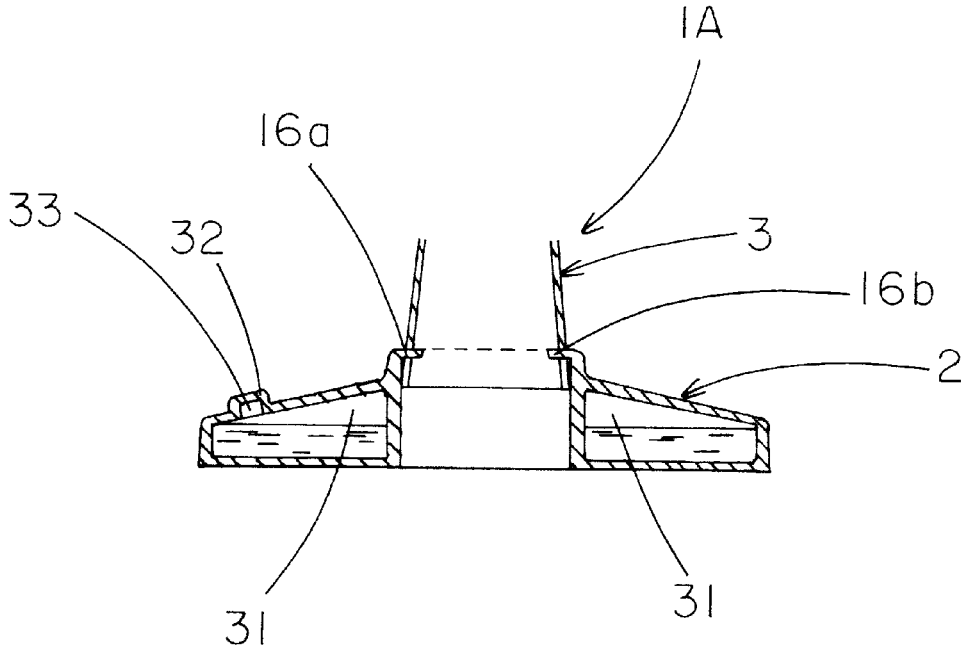
FIG. 8 is a cross sectional diagram of the principal part showing a modification of a supporter of the freestanding cylindrical indicator according to the second embodiment of the present invention.

Furthermore, FIG. 8 shows a modification of the supporter 2.

A chamber 31 is formed within the supporter 2 shown as the Figure. A tap 33 is formed on the top of the chamber 31 and it can be closed by a cap 32. The chamber 31 has a structure of keeping water, sand or the like within. Therefore, the supporter 2 is provided with an appropriate weight by simply supplying water, sand or the like into the chamber 31 on site so that the stability of the freestanding cylindrical indicator can be easily enhanced. Needless to say, since the supporter 2 becomes light in weight by simply discharging water, sand or the like from the tap 33, not only can it be carried readily but it is not necessary to separately prepare the weight 30.

Third Embodiment

Figure 9:
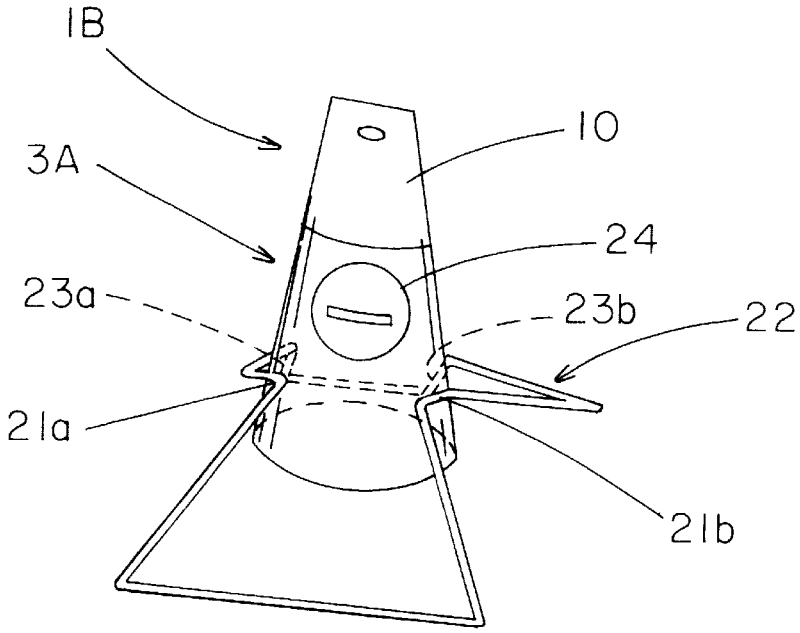
FIG. 9 is a diagonal diagram of a freestanding cylindrical indicator according to a third embodiment of the present invention.

FIG. 9 shows a freestanding cylindrical indicator 1B according to the third embodiment of the present invention.

A cylindrical body 3A of the freestanding cylindrical indicator 1B has the same structure as the cylindrical body 3 of the first embodiment. For example, a red-colored beltlike indicating portion 10 is printed on the side of the top end, and an indicating mark 24 on both sides about the middle section of the cylindrical body 3A.

In the present embodiment, the difference from the first embodiment is that slits 21*a,* 21*b* engaged with a supporter 22 are formed on both ends of an ellipse of the cylindrical body 3A turned around by 90 degrees on the outer periphery of the cylindrical body 3A in the direction of the major axis, while the slits 9*a,* 9*b* are formed on the cylindrical body 3 in the first embodiment.

Specifically, the supporter 22 of the present embodiment comprises at the upper part a symmetric pair of mountain-like interlocking portions 23*a,* 23*b* made of a bent steel wire which are inwardly close to each other.

By the configuration as described above, the mountain-like interlocking portions 23*a,* 23*b* of the supporter 22 are opened against the elasticity to engage with the slits 21*a,* 21*b* formed on the outer periphery of the cylindrical body 3A. As a result, the cylindrical body 3A is suppressed by the elasticity of the interlocking portions 23*a,* 23*b* and also can be securely engaged by the self-shape retentivity of the cylindrical body 3A itself together with the elasticity.

Fourth Embodiment

Figure 10:
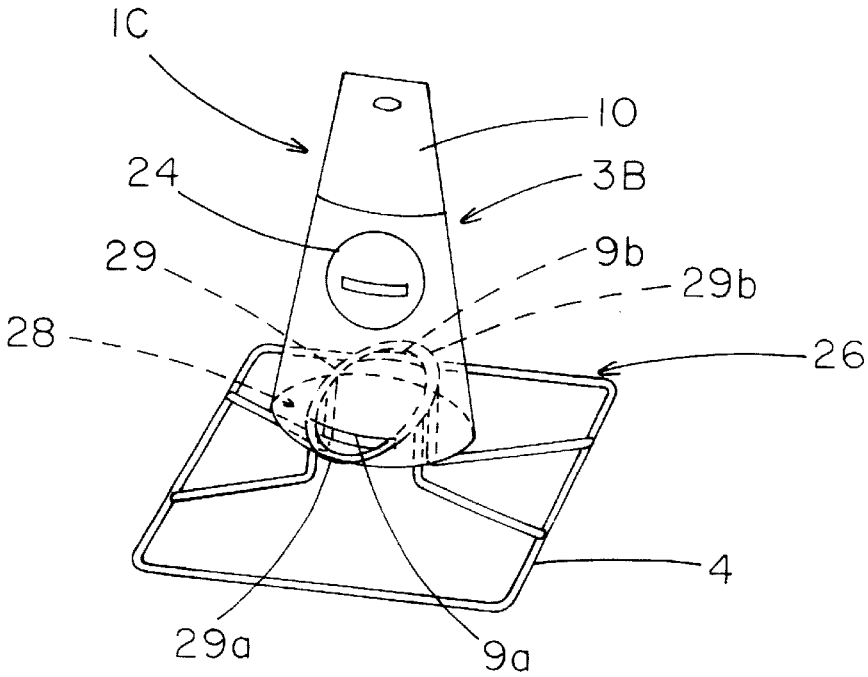
FIG. 10 is a diagonal diagram of a freestanding cylindrical indicator according to a fourth embodiment of the present invention.

FIG. 10 shows a freestanding cylindrical indicator 1C according to the fourth embodiment of the present invention. It is to be understood that a part of the configuration identical to that of the configuration of the freestanding cylindrical indicator 1B of the third embodiment is coded the same, and the detailed descriptions will be omitted.

A cylindrical body 3B of the freestanding cylindrical indicator 1C is configured the same as the aforementioned cylindrical body 3. For example, a red-colored beltlike indicating portion 10 is printed on the side of the top end and an indicating mark 24 on both sides about the middle section.

A supporter 26 of the present embodiment comprises a base 4, which has a wide rectangular or square shape by bending a steel wire, and a supporting ring 29 formed on the top face of the base 4.

The supporting ring 29 is formed to be have an elliptic shape by bending the same steel wire as the supporter 26, and a curved portion having a small radius is formed on both ends of the supporting ring 29 in the direction of the major axis as interlocking portions 29*a,* 29*b*.

By the configuration as described above, the elliptic supporting ring 29 is set to be in the same direction as the cylindrical body 3B and let into the elliptic opening formed on the bottom end of the cylindrical body 3B so as to have the same height as the slits 9*a,* 9*b*. Then, cylindrical body 3B is turned by 90 degrees to make the inner wall of the cylindrical body 3B externally expanded, and the interlocking portions 29*a,* 29*b* on the both ends of the supporting ring 29 in the major axis are engaged with the slits 9*a,* 9*b*.

Thus, the cylindrical body 3B is engaged in a state that it is externally expanded by the interlocking portions 29*a,* 29*b* and can be securely engaged together with the self-shape retentivity of the cylindrical body 3B itself.

The embodiments of the present invention are described above with reference to the accompanying drawings. It is to be understood that the specific configurations are not limited to the aforementioned embodiments, and modifications and additions to the present invention may be allowed without deviating from the gist thereof.

For example, the sheet member may be made of other materials such as a cardboard sheet and a synthetic resin sheet. The marks indicated on the cylindrical body are not limited to those described in the embodiments.

The cylindrical body is not limited to being formed by assembling the sheet member. For example, it may also be formed by molding a synthetic resin such as blow molding.

The cylindrical body may not be provided with the through hole 11 shown in the drawings.

The "cylindrical body" described above according to the present invention is tapered with the top end closed but can be a cylinder with a hollow interior.

What is claimed is:

1. A freestanding cylindrical indicator, comprising:

a cylindrical indicating means formed to be in a cylindrical body having an elliptic cross section, having a closed top end and an open bottom end, and having a hole near the bottom end of each of two opposing long trapezoidal sheets, said cylindrical body formed by inwardly folding edges of the two long trapezoidal sheets whose top end side is smaller than the bottom end side and by bonding mutually opposing folded edges with an adhesive agent; and a supporting means having a supporting ring with an inner periphery substantially equal to an outer periphery running through the holes in the cylindrical body and with a pair of interlocking portions in which two mutually opposing portions protrude inwardly in the direction of a minor axis, and having a base connected to the supporting ring, wherein said supporting means receiving the cylindrical indicating means, the supporting means lowered from the top side toward the bottom side of the cylindrical indicating means, and the cylindrical indicating means being deformed to a shape to fit the inner periphery of the supporting ring from the original elliptic shape, engages the pair of interlocking portions with the holes when said cylindrical indicating means is elastically pushed against the inner periphery of the supporting ring, to keep the cylindrical indicating means in a standing position.

2. The freestanding cylindrical indicator according to claim 1, wherein said cylindrical indicating means is made of cardboard sheets.

3. The freestanding cylindrical indicator according to claim 1, wherein said supporting means and said base are each made of a steel wire and connected to each other by means of welding.

4. The freestanding cylindrical indicator according to claim 1, wherein said supporting means and said base are integrally made of synthetic resin.

5. A freestanding cylindrical indicator, comprising:

a cylindrical indicating means formed to be in a cylindrical body having an elliptic cross section, having a closed top end and an open bottom end, and having a hole near bottom ends of each of two opposing sections in a single long trapezoidal sheet, said cylindrical body formed by folding a single long trapezoidal sheet whose top end side is smaller than the bottom end side along a folding line which is marked on said sheet to divide it into two equal sections in a longitudinal direction, and by bonding flaps formed by inwardly folding two edges of each section except the bottom end thereof, with an adhesive agent; and a supporting means having a supporting ring with an inner periphery substantially equal to an outer periphery running through the holes in the cylindrical body and with a pair of interlocking portions in which two mutually opposing portions protrude inwardly in the direction of a minor axis, and having a base connected to the supporting ring, wherein said supporting means receives the cylindrical indicating means, the supporting means being lowered from the top side toward the bottom side of the cylindrical indicating means, and the cylindrical indicating means being deformed to a shape to fit the inner periphery of the supporting ring from the original elliptic shape, engages the pair of interlocking portions with the holes when said cylindrical indicating means is elastically pushed against the inner periphery of the supporting ring, to keep the cylindrical indicating means in a standing position.

6. The freestanding cylindrical indicator according to claim 5, wherein said cylindrical indicating means is made of a cardboard sheet.

7. The freestanding cylindrical indicator according to claim 5, wherein said supporting means and said base are each made of a steel wire and connected to each other by means of welding.

8. The freestanding cylindrical indicator according to claim 5, wherein said supporting means and said base are integrally made of synthetic resin.

* * * * *

UNITED STATES PATENT AND TRADEMARK OFFICE

CERTIFICATE OF CORRECTION

PATENT NO. : 6,386,135 B1
DATED : May 14, 2002
INVENTOR(S) : Oshima, Reiji

It is certified that error appears in the above-identified patent and that said Letters Patent is hereby corrected as shown below:

Column 2,
Line 64, delete “A — A” and replace with -- VII – VII --;

Column 5,
Line 55, delete “3” and replace with -- 2 --.

Signed and Sealed this

Twenty-fourth Day of December, 2002

JAMES E. ROGAN
*Director of the United States Patent and Trademark Office*

UNITED STATES PATENT AND TRADEMARK OFFICE

CERTIFICATE OF CORRECTION

PATENT NO. : 6,386,135 B1
DATED : May 14, 2002
INVENTOR(S) : Oshima, Reiji

It is certified that error appears in the above-identified patent and that said Letters Patent is hereby corrected as shown below:

Title page,
Item [73], please add -- Oshima & Associates, Inc., Chiba, Japan --.

Signed and Sealed this

Twenty-second Day of July, 2003

JAMES E. ROGAN
*Director of the United States Patent and Trademark Office*